United States Patent [19]

Magome et al.

[11] 4,258,115

[45] Mar. 24, 1981

[54] WET DEVELOPING METHOD USING ELASTIC ROLLER FOR ELECTROSTATIC IMAGE AND A DEVICE THEREFOR

[75] Inventors: Tamotsu Magome, Kawasaki; Takashi Saito, Ichikawa, both of Japan

[73] Assignee: Canon Kabushiki Kaisha, Tokyo, Japan

[21] Appl. No.: 16,277

[22] Filed: Feb. 28, 1979

[30] Foreign Application Priority Data

Mar. 7, 1978 [JP] Japan ..... 53-25613
Mar. 8, 1978 [JP] Japan ..... 53-26182
Apr. 13, 1978 [JP] Japan ..... 53-43506

[51] Int. Cl.[3] ..... G03G 13/10; G03G 15/10

[52] U.S. Cl. ..... 430/125; 430/117; 430/118; 118/652; 118/661; 118/649

[58] Field of Search ..... 118/649, 650, 651, 652, 118/661, 644, 662; 430/12 S, 117, 118

[56] References Cited

U.S. PATENT DOCUMENTS 3,368,894 2/1968 Matkan et al. ..... 118/661 X

FOREIGN PATENT DOCUMENTS 52-40336 of 1977 Japan .
938349 10/1963 United Kingdom .
1122124 7/1968 United Kingdom .
1450690 9/1976 United Kingdom .
1456381 11/1976 United Kingdom .
1476559 6/1977 United Kingdom .
1491020 11/1977 United Kingdom .

*Primary Examiner*—John D. Welsh
*Attorney, Agent, or Firm*—Fitzpatrick, Cella, Harper & Scinto

[57] ABSTRACT

In developing an electrostatic image by supplying developing liquid to an electrostatic image bearing surface, the developing liquid is brought into contact with the image bearing surface to effect development of the electrostatic image, and then a developing member is urged against the image bearing surface to thereby effect supply of the developing liquid and collection of excess developing liquid by the developing member and thereby effect further development of the electrostatic image.

22 Claims, 15 Drawing Figures

WET DEVELOPING METHOD USING ELASTIC ROLLER FOR ELECTROSTATIC IMAGE AND A DEVICE THEREFOR

BACKGROUND OF THE INVENTION

1. Field of the Invention

This invention relates to the so-called wet developing method for visualizing an electrical latent image formed in electrophotography, electrostatic recording or the like, namely, an electrostatic latent image, with a liquid developer, and to a wet developing device for carrying out such a method.

In the art of image formation such as electrophotography, electrostatic printing, electrostatic recording and the like, various developing methods have been known and used to visualize or develop an electrostatic latent image on a latent image carrier such as a photosensitive medium using a photoconductive substance or an electrostatic recording material. In these known developing methods there is generally used so-called toner, namely, electroscopic particles which are more or less selectively drawn to or repulsed from the electrostatic charge of the latent image. When such toner is applied to the surface on which a latent image is carried, the developer particles adhere to the latent image area for direct reproduction or adhere to the area outside of the latent image for reversible reproduction.

When the developing is carried out with developer in a form of a dry powder it is called dry developing method and when the developing is carried out with liquid developer prepared by dispersing such toner in a carrier liquid, it is called a wet developing method. Both of these developing methods are widely known at present. Compared with the dry developing method, the latter mentioned method, that is, the wet developing method has the advantage that the apparatus required for carrying out the method is relatively simple in structure and that troubles involved in carrying out the method such as scatter of developer can be minimized. Therefore, the wet developing method is preferably used for a simple type image forming apparatus rather than the dry method.

The wet developing method may be defined as such developing method which comprises the step of making liquid developer contact the latent image carrying surface. The liquid developer is prepared by dispersing toner particles in a suitable dielectric carrier liquid having a volume resistivity greater than about $10^{10}\Omega$ cm and a dielectric constant less than 3 (for example, a paraffin hydrocarbons). When brought into contact with the latent image carrying surface, the toner particles dispersed in the carrier liquid are drawn to the electrostatic latent image and adhere thereto so as to visualize the latent image.

2. Description of the Prior Art

There are a great variety of wet developing methods such as cascade method, immersion method, method using a jet of developing liquid, or method of supplying developing liquid by the use of a roller formed of a humidity-containing material such as sponge, felt or the like. In these arts of wet development, high speed has recently become a particularly important goal. To accomplish such high-speed development, developing liquid of high concentration must be supplied to the electrostatic image bearing surface at high speed and excess developing liquid must be collected efficiently. In addition, it is important to provide a visualized image of good quality from which excess developing liquid has been sufficiently removed. As a system which substantially satisfies the several needs in such a wet developing art, there is known a method in which an elastic roller or belt of liquid-retaining property having a liquid-passing surface is used as the developing liquid supply means and development of the electrostatic image on the electrostatic image bearing member is effected at the region whereat the roller or belt is urged against the image bearing member. Details of this wet developing method are disclosed in Japanese Patent Laid Open No. 40336/1977. According to this method, at the region whereat the elastic roller or belt (hereinafter referred to as the elastic roller) is urged against the electrostatic image bearing member, squeeze-out and supply of developing liquid and press-out of excess developing liquid are effected at the same time in accordance with the elastic deformation of the elastic roller itself and thus, the time required for the development is short and in this point, this method is found to be advantageous over the other known methods such as the wet developing method using an immersion bath or the wet developing method using a jet of developing liquid. Incidentally, the aforementioned Japanese Patent Laid Open No. 40336/1977 describes that, as an example, an elastic roller comprising a sponge roller covered with a flexible netting is used as developing means. Such elastic roller has the property of squeezing out liquid previously absorbed therein and of absorbing liquid thereinto by being rotatively urged against the surface of a rigid member such as photosensitive medium or insulating member so as to be elastically deformed and thereby form a desired width of nip. Therefore, where such roller is used as the developing means for electrostatic image, the usefulness thereof would be sufficiently recognized. In the course of studies carried out to apply the above-described elastic roller for the development of electrostatic image in accordance with such knowledge, the inventors have found several merits and demerits of the wet developing method using such an elastic roller. That is, according to this developing method, development, defogging and removal of excess developing liquid are accomplished simultaneously in the developing step and this has the advantage that the time required for development is very short, that no edge effect appears in the visualized image, and that copying on a long footage of copy paper or continuous copying at short intervals is possible. On the other hand, this roller developing method has the disadvantage that the visualized image obtained thereby lacks sharpness and that the visualized image is low in resolving power.

SUMMARY OF THE INVENTION

It is therefore a primary object of the present invention to provide an improved, novel wet developing method using the above-described roller which can provide a visualized image excellent in sharpness and have high resolving power while maintaining the merits of the roller developing method and to provide an improved, novel wet developing device using the above-described elastic roller as the wet developing means which can provide a visualized image excellent in sharpness and high resolving power while maintaining the merits of the elastic roller.

It is another object of the present invention to provide a wet developing method which has the following numerous features:

1. high suitability for high-speed copying;
2. capability of effecting copying in a narrower area than in the conventional wet development;
3. Capability of intensely squeezing developing liquid and reducing the quantity of liquid consumed;
4. Capability of producing a clear image free of fog;
5. Capability of reducing the area over which the developing liquid is exposed to the atmosphere and reducing quantity of liquid evaporated; and
6. Capability of stably producing visualized images of high quality for a long time, and to provide a wet developing device for carrying out the same method.

The present invention which achieves these objects, in brief, is a method of wet-developing an electrostatic image by supplying developing liquid to an electrostatic image bearing surface, which method comprises a first step of bringing said developing liquid into contact with said bearing surface to effect development of the electrostatic image, and a second step of urging a developing member against said bearing surface after said first step to thereby effect supply of said developing liquid and collection of excess developing liquid by said member and thereby effect further development of said electrostatic image, and a device for carrying out the same method.

Further, the present invention is a device for wet-developing an electrostatic image which comprises a developing member for supplying developing liquid to an electrostatic image formed on an electrostatic image bearing member by being urged against said bearing member as the means for developing said electrostatic image with developing liquid and for collecting excess developing liquid, and a liquid pool forming member disposed in proximity to said developing member and said bearing member for forming a pool of developing liquid.

Still further, the present invention is a device for wet-developing an electrostatic image which comprises a developing member for supplying developing liquid to an electrostatic image bearing member by being urged against said bearing member and rotated as the means for developing an electrostatic image formed on said bearing member with developing liquid and for collecting excess developing liquid, and a liquid pool forming rotatable member having a portion of the peripheral surface thereof in contact with said developing member, said liquid pool forming rotatable member being disposed in proximity to said bearing member to form a developing liquid pool area.

BRIEF DESCRIPTION OF THE DRAWINGS

The invention will become more fully apparent from the following detailed description thereof taken in conjunction with the accompanying drawings, wherein.

DESCRIPTION OF THE PREFERRED EMBODIMENTS

First, details of an elastic roller which is a developing member applied to the present invention hereinafter described in detail will be described with respect to a specific example thereof.

Figure 1:
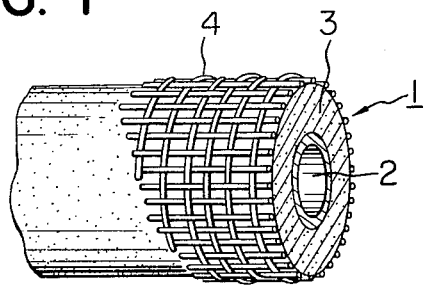
FIGS. 1 to 3 schematically illustrate an elastic roller and an elastic belt applicable as developing means in the present invention.
Figure 2:
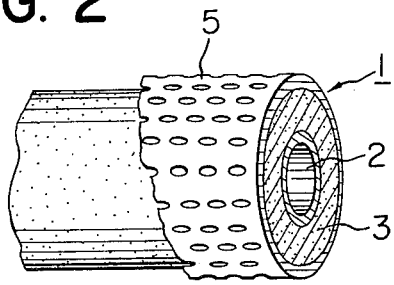

The outline of the construction of a portion of the elastic roller used as the developing roller in the present invention is illustrated in FIGS. 1 and 2.

The illustrated elastic roller basically comprises a central roller which provides a rotary shaft, a porous elastic member surrounding the central roller, and an outermost flexible member having a number of through-apertures therein.

In FIG. 1, the elastic roller 1 has a shaft 2 formed of a rigid material such as metal or hard synthetic resin, an elastic foam member 3 surrounding the shaft 2 and formed of, for example, foamed polyurethane or the like, and a netting 4 covering the foam member 3. The foam member 3 is adhesively or otherwise secured to the shaft 2, and the netting 4 is supported around the foam member 3 by the resiliency of the foam member 3 which is more or less compressed inside the netting, whereby rotation of the central shaft 2 may cause rotation of the foam member 3 and the netting 4 as a unit. The foam member 3 has an elastically deformable, continuous hole and can therefore effect absorption and squeeze-out of liquid. The outermost netting 4 is a flexible net provided by weaving thin wire of stainless steel, natural fiber or synthetic fiber, and liquid may go into and out of the foam member 3 through the texture of the netting 4. That is, when the elastic roller 1 impregnated with liquid is compressed, the liquid in the foam member 3 is squeezed out through said texture and conversely, when the foam member 3 is restored to its original state by being released from its compressed state, the liquid present on the surface of the netting 4 is absorbed into the interior of the foam member 3 through said texture.

Netting of 100 to 300 meshes is suitable as the netting 4. Also, it is desirable for the netting to have an opening rate of 30% or more in order that absorption and squeeze-out of developing liquid may be effected efficiently. Further, with the liquid-passing property, mechanical strength, chemical stability, etc. of the netting taken into account, the netting may particularly preferably be formed of monofilament thread such as polyamide, polyester, polypropylene, polyether, vinylon or the like. Where a netting is employed as in the illustrated example, the netting may be formed by plain fabric, diagonal cloth or satin weave and such netting may be pressed and deformed. The attachment of the netting to the foam member 3 may be effected as shown in the example of FIG. 1 wherein the lateral fiber axis of the netting is coincident with the rotary shaft, but alternatively, the netting may be attached to the foam member 3 with the fiber axis forming an angle with the rotary shaft. Other various modified constructions may of course be adopted as such elastic roller. More particularly, the member forming the outermost peripheral surface of the elastic roller may be formed of any material having, as its characteristics, through-apertures which do not shut off the interior and and exterior of the elastic roller, and flexibility in the direction perpendicular to the peripheral surface on that surface which contacts the other rigid surface so that the through-apertures are not blocked by the contact surface during the contact. Therefore, this member may be provided not only by the netting as described above, but also by a thin metal plate or a resin film formal with a number of apertures therein as in the example shown in FIG. 2. In FIG. 2, reference character 5 designates a sleeve of such apertured film, the through-apertures being circular in shape. The shape of the through-apertures is not restricted to circular shape but may be a rectangular shape, an elliptical shape or a mosaic shape or a combination thereof. The foam member 3 in FIGS. 1 and 2 is not restricted to a single layer but may be formed into a plurality of layers.

The foam member 3 may be formed of a material which is capable of absorption and squeeze-out of liquid and which exhibits an appropriate degree of elasticity. For example, use may be made of a foamed material such as polystyrene, polyethylene, polyurethane, polyvinyl chloride, NBR (nitrile butylene rubber), SBR or the like, or of an elastic material formed by collecting natural or synthetic fiber or metallic fiber or the like. Such foam member 3 includes a continuous foam portion having liquid-passing property and liquid-retaining property and an independent foam portion which is not concerned with the liquid-passing property, and the independent foam portion should preferably occupy at least 10% of the foam portion in order that the elasticity of the foam member 3 itself may be maintained sufficiently to be effective for the absorption and squeeze-out of liquid.

The central shaft 2 has the function of supporting the foam member 3 and is usually formed of a rigid material including a metal such as stainless steel, aluminum or the like, or plastics such as polyoxymethylene, polyamide or the like.

In the above-described construction, the central shaft 2 and the foam member 3 should preferably be adhesively secured to each other. On the other hand, the foam member 3 and the netting 4 should preferably be non-adhesively secured to each other. This preferably results in a greater effect of liquid absorption and squeeze-out by the foam member 3.

If at least one of the above-mentioned members forming the elastic roller is electrically conductive, this will act as a developing electrode for the electrostatic image bearing surface such as a photosensitive medium, which in turn would lead to an advantage that the developing action and the action of collecting excess developing liquid can be performed more effectively.

Figure 3:
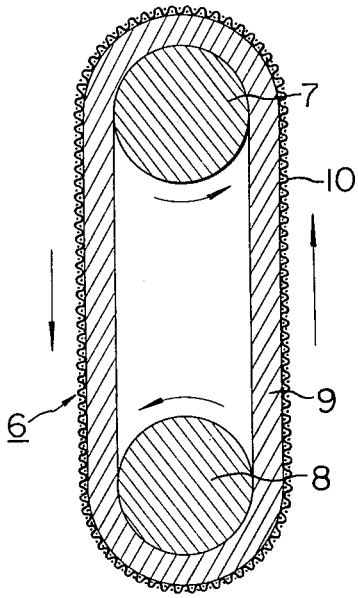

In the present invention, the elastic roller illustrated in FIGS. 1 and 2 may be modified into the form of an endless belt as shown in FIG. 3.

The example shown in FIG. 3 is one in which an elastic belt 6 comprising an elastic foam member 9 and a netting 10 may be integrally moved around rotatable rollers 7 and 8. The members forming the belt 6 may be formed of the materials mentioned with respect to FIGS. 1 and 2, and to ensure the rotational movement of the elastic foam member 9, the side of the foam member 9 which contacts the rotatable rollers 7 and 8 may be formed by the use of a material having a high frictional resistance, or the surface of the rotatable rollers 7 and 8 may be made coarse to ensure positive and smooth rotational movement of the foam member 9.

An embodiment of the present invention will hereinafter be described in greater detail with respect to an electrophotographic copying apparatus and by reference to the drawings. In the embodiment described hereinafter, a netting is shown as the member forming the outermost peripheral surface of the elastic roller and only the roller is shown but the developing member formed into the form of an endless belt is not. This is just for simplicity of illustration and the scope of the present invention is not restricted to the illustrated example.

Figure 4:
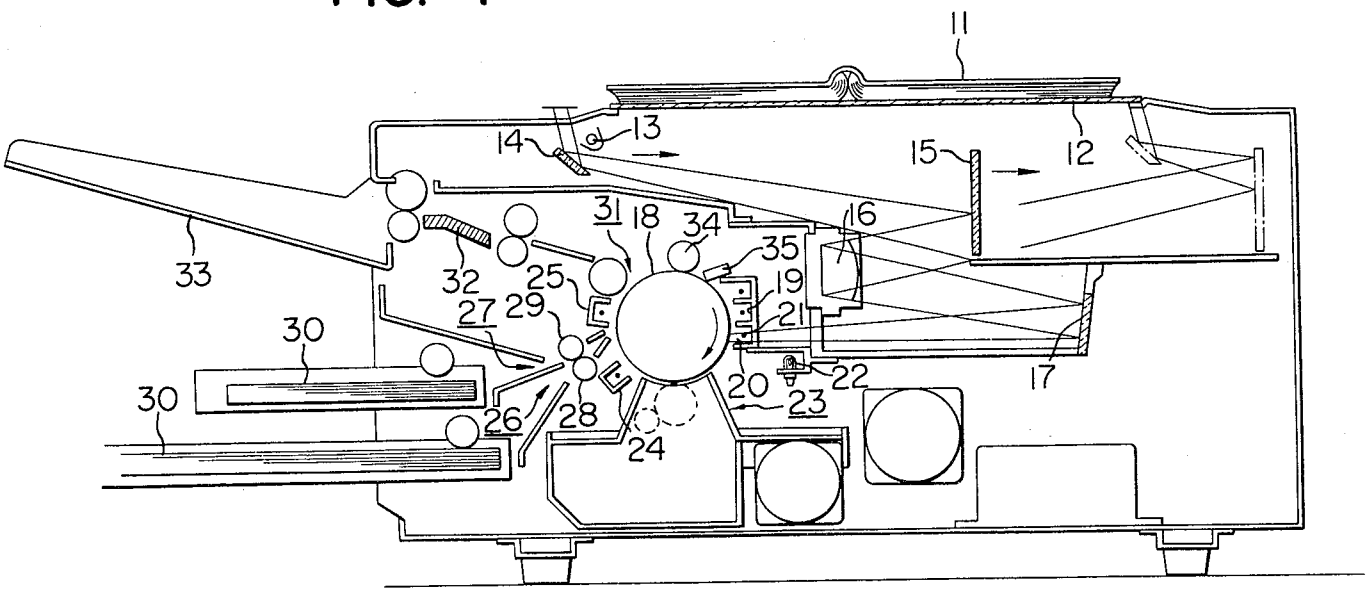
FIGS. 4 and 5 are schematic cross-sectional views of an electrophotographic copying apparatus illustrating an embodiment of the present invention.

The purport of the present invention can be explained by FIGS. 4 to 15 which show an electrophotographic copying apparatus as an example. In FIG. 4, an original 11 to be copied is placed on an original carriage 12 forming an original supporting surface. The image of the original is formed on a drum 18 by an optical system comprising an illuminating lamp 13, a first mirror 14 movable with the illuminating lamp, a second mirror 15 movable at half the velocity of the first mirror 14 and in the same direction as the first mirror 14, a fixed in-mirror lens 16 and a fixed mirror 17. The surface of the drum 18 is a photosensitive surface and the method of forming a latent image on such surface is well-known. For example, the surface of the drum 18 is uniformly charged by a primary charger 19 and, when the surface of the drum comes to an image forming station 20, it is exposed to light while at the same time it is discharged by a discharger 21, and then the whole surface of the drum is exposed to light by a whole surface exposure lamp 22, to thereby form an electrostatic latent image on the drum surface. The latent image so formed on the drum surface is made into a visible image by a developing device 23 which will be further described hereinafter and is not shown here. (Details of the developing device 23 will hereinafter be described.) It is to be noted that, in the apparatus of the shown embodiment, the developing liquid squeezing means heretofore used in addition to the developing device 23 is not necessary.

The latent image on the drum is usually developed into a visible image by toner contained in the developing liquid, and a post-charger 24 is provided for imparting weak corona discharge immediately after the development to charge the drum surface in order to increase the force with which the toner is adsorbed to the drum surface. The visible image on the drum is transferred onto copy paper 30 by an image transfer charger 25, the copy paper being supplied from a paper supply station 26 or 27 and paid away so that the leading end edge of the paper is caused to be coincident with the leading end of the visible image on the drum by a set of register rollers 28, 29. After the image transfer, the copy paper is separated from the drum at a separating station 31 and directed to a fixing station 32 for fixation thereat, whereafter the copy paper is discharged onto a tray 33. On the other hand, the drum surface is pre-cleaned by a cleaning roller 34 which is urged against the drum surface and rotated in the opposite direction to the drum, and then the drum surface is completely cleaned by a cleaning blade 35, thus becoming ready for another cycle.

Figure 5:
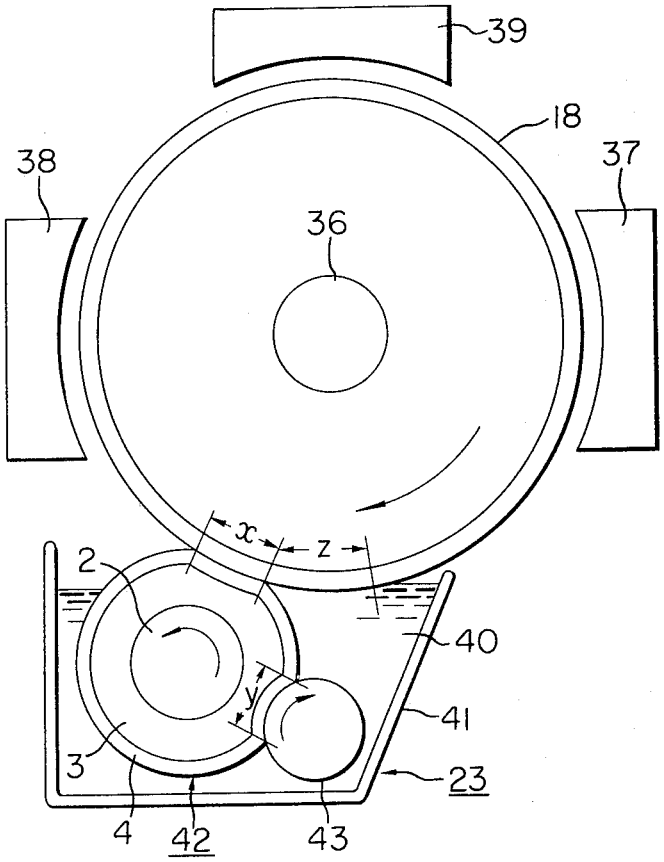

In FIG. 5, details of the developing device 23 of the present invention are shown. In FIG. 5, the elements identical to those shown in the above-described example are given identical reference characters. Referring to FIG. 5, reference numeral 18 designates a drum-shaped photosensitive medium which is rotatable in the direction of arrow about the rotary shaft 36 thereof. Designated by 37 is a latent image formation means for forming an electrostatic latent image on the photosensitive medium 18. Denoted by 23 is a developing device, 38 a transfer means for transferring the developed image on to an image transfer medium, and 39 a cleaning means for cleaning the photosensitive medium to remove unnecessary developer therefrom and erase unnecessary latent image. The drum-shaped photosensitive medium 18 is circulated in the direction of arrow along the above-noted means 37, 23, 38 and 39. The developing device 23 is disposed below the photosensitive medium 18 and chiefly comprises a liquid bath 41 for containing developing liquid 40, a developing roller 42 partly immersed in the developing liquid 40 within the liquid bath 41, and a refresh roller 43 urges against the developing roller 42. As already noted in connection with FIG. 1, the developing roller 42 comprises a central shaft roller 2, an elastic foam member 3 surrounding the central shaft roller 2, and a netting 4 endlessly covering the foam member 3.

Now, the photosensitive medium 18 having a latent image formed thereon is brought into contact with the developing liquid 40 filling the liquid bath 41, in the developing device 23, so that development is effected.

In the present invention, the time required for the development in this portion, namely, the portion indicated by Z, may be very short. In other words, in practice, the width of the portion Z (the width over which the photosensitive medium 18 is in direct contact with the developing liquid 40) will be sufficient if it is of the order of about 10 to 30 mm.

In the developing method of the present invention, it is contemplated that the so-called edge development will be effected in this portion and therefore, the time required for the latent image formed on the photosensitive medium to be in contact with the developing liquid may be very short. This is because the edge portion of the latent image has so high an electric field that its development can be completed in a moment.

In the present invention, roller development takes place later and in this connection, the present invention permits the use of a developing liquid higher in concentration than that heretofore used in the conventional liquid developing method and therefore, in that case, the above-mentioned edge development may be achieved more easily. In the portion Z, as described above, the edge development chiefly takes place to provide a visible image which is sharp and high in resolving power. On the other hand, fog is generally created on the visible image. Then, development of the latent image is further effected at a position whereat the developing roller 42 is urged against the photosensitive medium 18. The photosensitive medium 18 and the developing roller 42 are rotated in the same direction (the direction of arrow) substantially at the same velocity while the latter is being urged against the former. The developing roller 42, in its state of having sufficiently absorbed the developing liquid 40, contacts the photosensitive medium 18 to form a nip (shown as X portion) to thereby cause the electrostatic image formed on the photosensitive medium 18 to be further developed by the amount of developing liquid squeezed out by the developing roller 42. Subsequently, when the portion of the developing roller 42 which is urged against the photosensitive medium 18 is separated from the photosensitive medium 18, the developing roller 42 sucks in the excess developing liquid present near the photosensitive medium 18 with the aid of the force of restitution of the elastic foam member 3. Further, the developing roller 42 is urged against the refresh roller 43 in the developing liquid 40 while forming a nip (shown as y portion) and thereat, replenishment of the developing liquid is effected to render the developing device ready for another developing cycle.

In the example shown in FIG. 4, a portion of the developing roller 42, for example, the elastic foam member 3, may be caused to have an electrode effect so as to ensure further positive removal of the fog when a so-called developing bias is applied to this roller 42. That is, as already described, in the development effected in the x portion, the effective developing electrode is positioned in proximity so that the fog-removing field acts strongly to substantially eliminate the possibility of occurrence of fog even when developing liquid of high concentration is used.

In the above-described example of the device, the substantial developing time is the time for which the photosensitive medium 18 is in contact with the developing roller 42 and it is very easy to greatly reduce such time, namely, to provide a high process speed. Again in that case, it is possible to reliably obtain an image of high resolution having sufficient sharpness.

In the present invention, it is the essential point to effect the edge development of the latent image prior to the roller development and therefore, the developing device including the construction for effecting such edge development is not restricted to the example shown in FIG. 5.

As a preferred example of the developing device to carry out the present invention, other examples will hereinafter be described by reference to the drawings which show only the essential portions thereof. The components identical to those shown in the above-described example are given identical reference characters.

In the example shown in FIG. 6, like the example shown in FIG. 5, the developing device 23 is disposed below the photosensitive medium 18 and chiefly comprises a liquid bath 41 for containing developing liquid 40 therein, a liquid receiving dish 44 for temporally preserving the developing liquid 40 along the surface of the photosensitive medium 18, a developing roller 42 partly immersed in the developing liquid 40 within the liquid bath 41, and a refresh roller 43 urged against the developing roller 42. The developing roller 42, as already described in connection with FIG. 1, comprises a central shaft roller 2, an elastic foam member 3 surrounding the central shaft roller and a netting 4 endlessly covering the foam member 3. The photosensitive medium 18 and the developing roller 42 are rotated in the same direction (the direction of arrow) and substantially at the same velocity while the latter is urged against the former. The developing roller 42, in its state of having sufficiently sucked in the developing liquid 40, contacts the photosensitive medium 18 to form a nip (shown as x portion) and the developing liquid squeezed out by the developing roller 42 fills and stays in the clearance (shown as Z portion) between the photosensitive medium 18 and the liquid receiving dish 44 disposed in proximity thereto. Incidentally, the aforementioned clearance may be of the order of 1 to 5 mm in practice. Also, the width over which the liquid receiving dish 44 is opposed to the photosensitive medium 18 may be approximately 10 to 30 mm.

Development of the latent image formed on the photosensitive medium is first effected by the developing liquid filling the clearance between the photosensitive medium 18 and the liquid receiving dish 44 in the manner as described above. The ensuing step of development effected by the developing roller 42 is just as described with respect to the example shown in FIG. 5. The liquid receiving dish 44 may be formed of a conductive material or a conductive material covered with an insulating material so as to act as an opposed developing electrode (floated condition) of the photosensitive medium 18.

However, in the present invention, it is chiefly contemplated that edge development will be effected at such a location and in this sense, it is rather undesirable for the liquid receiving dish 44 to have too strong an electrode effect.

Figure 7:
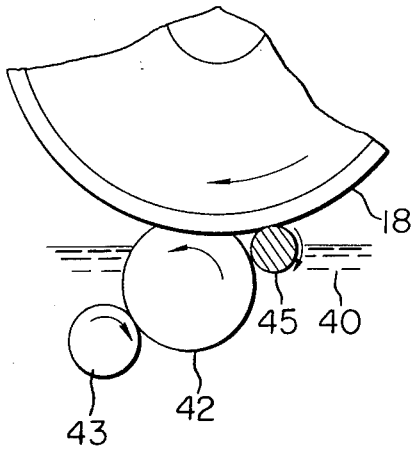

The example shown in FIG. 7 is one in which a rotatable member 45 is disposed in proximity to the region whereat the developing roller 42 is urged against the photosensitive medium 18. The rotatable member 45 may be either fixed or rotatable about any axis. However, where the rotatable member is rotated in the direction of arrow, it has the effect of raising the developing liquid 40 and this is desirable. On the peripheral surface of the rotatable member 45, there may be provided an unshown groove to increase the amount of the developing liquid 40 which stays there or which is raised.

Figure 8:
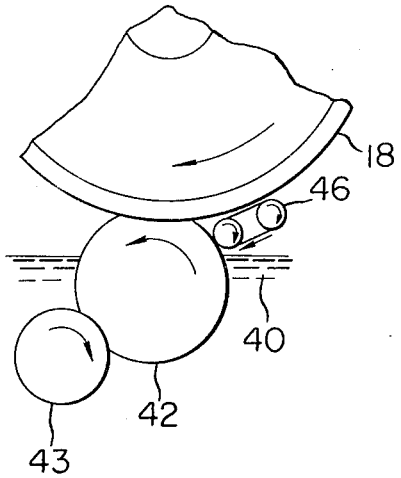

The example shown in FIG. 8 is one in which an endless belt 46 is disposed along and in proximity to the peripheral surface of the photosensitive medium 18. Of course, again in this case, it is a matter of free choice that the belt 46 is fixed or rotatable.

Figure 9:
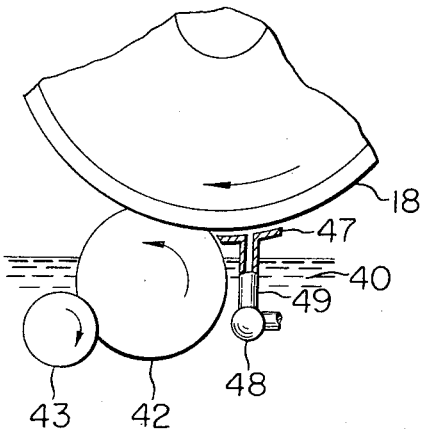

In the example shown in FIG. 9, a liquid receiving dish 47 having an opening at the shown position is disposed and a pump 48 communicating with the opening is used to inject the developing liquid 40 toward the surface of the photosensitive medium 18 through a conduit 49. In this device, modification may be made such that another liquid bath, instead of the pump 48, is provided as the source for supplying the developing liquid onto the liquid receiving dish 47.

Figure 10:
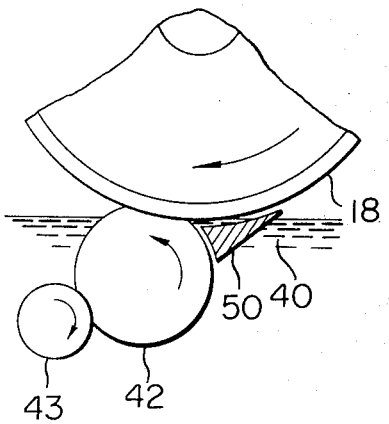

The example shown in FIG. 10 is one in which a liquid control member 50 substantially entirely embedded in the developing liquid 40 is disposed in proximity to the photosensitive medium 18 and the developing roller 42.

Figure 6:
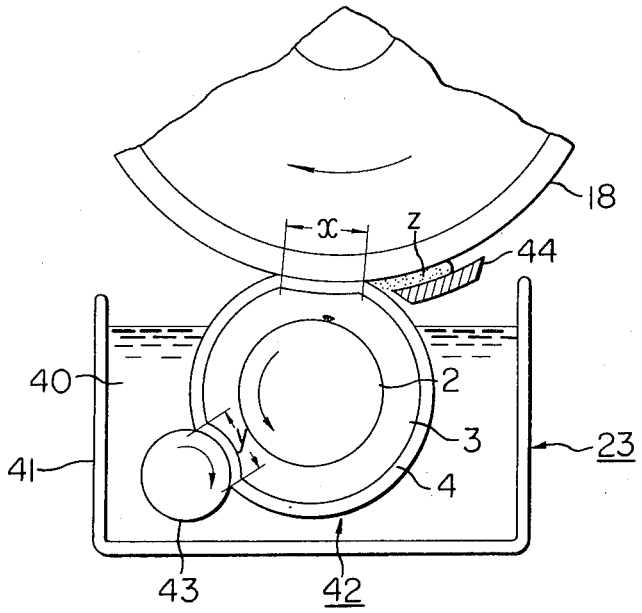
FIGS. 6 through 15 are schematic cross-sectional views showing only the essential portions of the developing device for illustrating further embodiments of the present invention.
Figure 11:
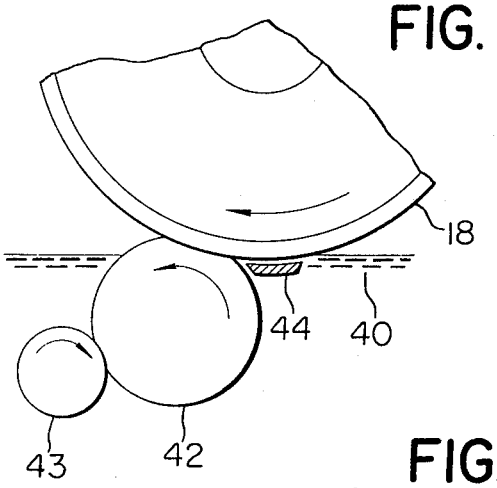

The example shown in FIG. 11 is an embodiment in which the liquid receiving dish 44 of the FIG. 6 example is entirely embedded in the developing liquid 40 and the developing liquid 40 pre-filling the clearance between the photosensitive medium 18 and the liquid receiving dish 44 pre-contacts the photosensitive medium 18.

Figure 12:
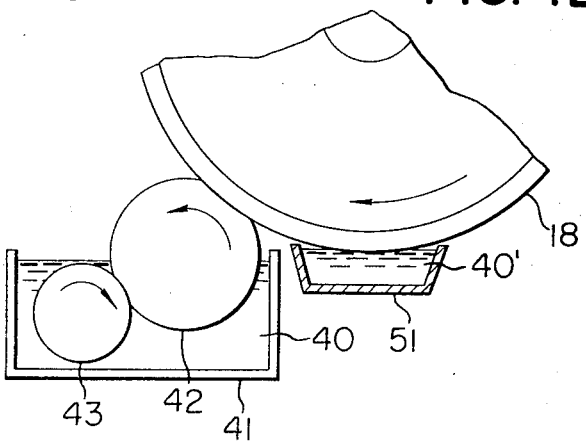

FIG. 12 shows an embodiment in which a liquid reservoir 51 for developing liquid 40' is provided independently of the liquid bath 41 containing therein the developing roller 42 and the refresh roller 43. In this example, the photosensitive medium 18 first makes contact with the developing liquid 40' to have the latent image thereon developed, and then the latent image is further developed at the region whereat the developing roller 42 is urged against the photosensitive medium.

Here, further embodiments will be described by reference to FIGS. 13 to 15.

Figure 13:
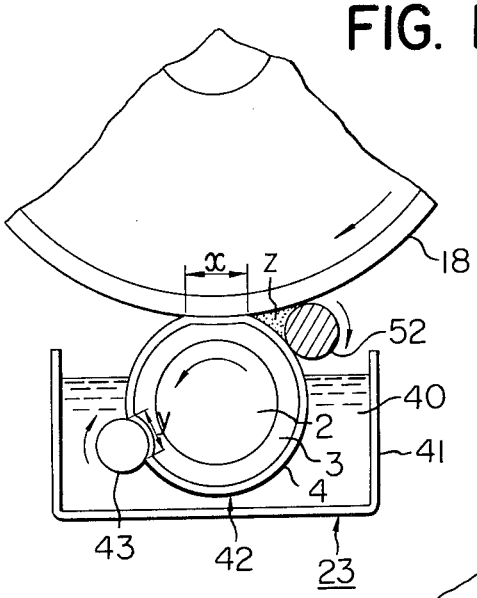

In the embodiment of FIG. 13, as in the above-described embodiments, the photosensitive medium 18 and the developing roller 42 are rotated in the same direction (the direction of arrow) and substantially at the same velocity while the latter is urged against the former. The developing roller 42, in its state of having sufficiently sucked in the developing liquid 40, contacts the photosensitive medium 18 to form a nip (shown as x portion). The developing liquid squeezed out by the developing roller 42 fills a concave clearance (shown at z) formed by the peripheral surfaces of a roller 52 and the developing roller 42, the roller 52 being rotatably disposed in proximity to the photosensitive medium 18 and in contact with the developing roller 42. In this embodiment of the device, the development of the latent image formed on the photosensitive medium is first effected by the developing liquid staying at such region (z portion). The time required for the development at this portion, i.e., the z portion, may be very short.

In this embodiment, it is desirable that the roller 52 be disposed so as to be rotatable in the opposite direction (the direction of arrow) with respect to the developing roller 42. The rotation of this roller 52 increases the action of raising the developing liquid toward the peripheral surface of the photosensitive medium 18 to thereby ensure reliable and easy contact between the developing liquid and the photosensitive medium.

Incidentally, in the present invention, it is chiefly contemplated that edge development will be effected at such a region as described above, and in this sense, it is rather undesirable for the roller 52 to have a strong electrode effect with respect to the photosensitive medium 18.

In the z portion, edge development is effected as described with the result that there is obtained a visible image which is sharp and high in resolving power. However, fog is generally created over this visible image.

Subsequently, further development is effected by the developing roller 42 urged against the photosensitive medium 18. Next, in the example shown in FIG. 14, a roller 53 of elastic material is urged against the developing roller 42 at a position proximate to the region whereat the developing roller 42 is urged against the photosensitive medium 18. Where the peripheral surface of the roller 53 of elastic material is in close contact with the peripheral surface of the developing roller 42 as in the present example, a pool of developing liquid (shown as z portion) may be reliably formed. Also, in the region whereat the roller 53 of elastic material is urged against the developing roller 42, it is preferable to prevent squeeze-out of the developing liquid absorbed by the developing roller 42 and for this purpose, the roller 53 may preferably be formed of a softer material than the developing roller 42.

Figure 14:
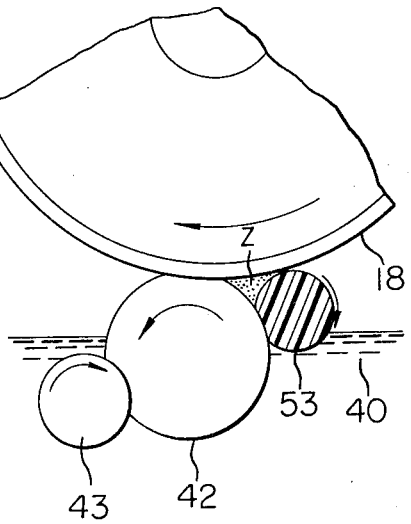

Although not shown, in the example shown in FIG. 13 or 14, a number of grooves may be formed in the outer peripheral surface of the roller 52 or the roller 53 which makes contact with the developing roller 42. In that case, the grooves have the effect drawing up the developing liquid and this leads to the ease with which a pool of developing liquid is formed.

Figure 15:
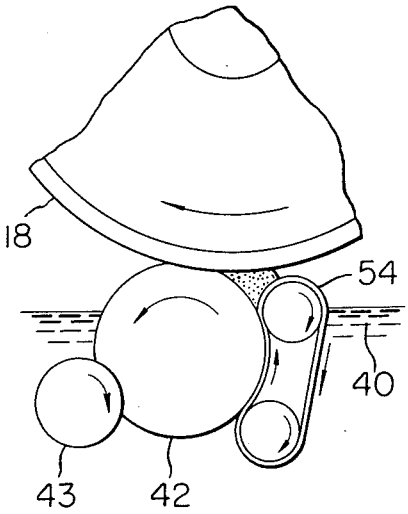

The example shown in FIG. 15 is one in which an endless belt 54 proximate to the photosensitive medium 18 is disposed along the peripheral surface of the developing roller 42. Of course, in this case, it is a matter of free choice that the belt 54 itself rotates or is driven from the developing roller 42. Grooves may be formed in the outer periphery of the belt 54.

In the above-described examples shown in FIGS. 7 to 15, any of the rotatable member 45, belt 46, 54, liquid receiving dish 47, liquid control member 50, liquid reservoir 51, roller 52 and roller 54 of elastic material may be made to have an electrode effect as already described in connection with the FIG. 6 example. However, whether these are made to have an electrode effect or not is optional.

The positional relationship between the photosensitive medium 18 and the developing roller 42 has not been specifically specified, but in the present invention, the developing roller 42 may be installed right below the photosensitive medium 18 or upstream or downstream in the moving direction of the photosensitive medium.

The effects of the present invention so far described in detail may be enumerated as follows:

(1) In spite of its simple construction, the device of the present invention can provide visible images which have sharpness and which are high in resolving power, without formation of fog and at high speed.

(2) Images free of the edge effect can be provided.

(3) The substantial time required for the development is short and removal of excess developing liquid is effected and therefore, high-speed image formation can be achieved.

(4) Development of the electrostatic image and a strong squeeze of excess developing liquid is effected in a short time and this is convenient for the construction of a high-speed copying machine.

(5) The necessity of the liquid squeezing means used after development as required in the prior art is eliminated and this leads to a compact construction of the entire image formation apparatus including the developing device.

(6) Strong squeeze of the developing liquid can be always achieved and this leads to the provision of high-quality visible images having no disturbance and a reduction in quantity of the developing liquid consumed.

(7) Clear visible images free of fog may be ensured for a long time.

(8) The quantity of developing liquid carried out is small and the quantity of developing liquid evaporated outwardly of the machine is small, thus reducing the possibility of air pollution.

(9) Compared with the conventional apparatus, the developing process can be carried out efficiently in a narrow area.

What we claim is:

1. A method of developing an electrostatic image by supplying developing liquid to an electrostatic image bearing surface, said method comprising a first step of bringing said developing liquid into contact with said bearing surface to effect development of the electrostatic image, and a second step of urging an elastic member having an endless outer surface and which squeezes out and absorbs liquid in accordance with its elastic deformation against said bearing surface after said first step to effect supply of said developing liquid and absorption of excess developing liquid by said member and thereby effect further development of said electrostatic image.

2. A method according to claim 1, wherein during said first step there is formed a pool of developing liquid which contacts said electrostatic image bearing surface so that the electrostatic image is developed by said pool of developing liquid.

3. A method according to claim 1, wherein during the second step said electrostatic image bearing surface and said elastic member are moved relative to each other in the same direction and substantially at the same velocity at the surface of contact therebetween.

4. A method according to claim 1, wherein during the second step said elastic member effects development of said electrostatic image while functioning as a developing electrode.

5. A method according to claim 1, wherein said first and second steps take place continuously in time.

6. A device for wet-developing an electrostatic image comprising a developing member for supplying developing liquid to an electrostatic image formed on an electrostatic image bearing member by being urged against said bearing member as the means for developing said electrostatic image with developing liquid and for collecting excess developing liquid, and a liquid pool forming member disposed in proximity to said developing member and said bearing member for forming a pool of developing liquid.

7. A device according to claim 6, wherein said developing member is an elastic member formed into a roller or an endless belt which effects liquid squeeze-out and absorbing actions in accordance with the elastic deformation thereof.

8. A device according to claim 6, wherein said electrostatic image bearing member takes the form of a drum and is disposed so as to be rotatable substantially at the same velocity as the developing member urged thereagainst.

9. A device according to claim 6, wherein said liquid pool forming member is in the form of a plate.

10. A device according to claim 6, wherein said liquid pool forming member is a roller.

11. A device according to claim 6, wherein said liquid pool forming member is an endless belt.

12. A device according to claim 6, wherein said liquid pool forming member is formed of a material having an effect as a developing electrode of said electrostatic image bearing member.

13. A device according to claim 6, wherein said developing member is formed of a material having an effect as a developing electrode of said electrostatic image bearing member.

14. A device for wet-developing an electrostatic image comprising a developing member for supplying developing liquid to an electrostatic image bearing member by being urged against said bearing member and rotated as the means for developing an electrostatic image formed on said bearing member with developing liquid and for collecting excess developing liquid, and a liquid pool forming rotatable member having a portion of the peripheral surface thereof in contact with said developing member, said liquid pool forming rotatable member being disposed in proximity to said bearing member to form a developing liquid pool area.

15. A device according to claim 14, wherein said developing member is an elastic member formed into a roller or an endless belt which effects liquid squeeze-out and absorbing actions in accordance with the elastic deformation thereof.

16. A device according to claim 14, wherein said electrostatic image bearing member takes the form of a drum and is disposed so as to be rotatable substantially at the same velocity as the developing member urged thereagainst.

17. A device according to claim 14, wherein said liquid pool forming rotatable member is a roller or an endless belt.

18. A device according to claim 14, wherein at least the outer peripheral surface of said liquid pool forming rotatable member is formed of an elastic material.

19. A device according to claim 14, wherein said liquid pool forming rotatable member has grooves formed in the outer peripheral surface thereof.

20. A device according to claim 14, wherein said liquid pool forming rotatable member is rotatable so that the direction of movement of said liquid pool forming rotatable member is the same as that of said developing member at the surface of contact therebetween.

21. A device according to claim 14, wherein said liquid pool forming rotatable member is formed of a material having an effect as a developing electrode of said electrostatic image bearing member.

22. A device according to claim 14, wherein said developing member is formed of a material having an effect as a developing electrode of said electrostatic image bearing member.

* * * * *